US011795741B1

(12) United States Patent
Fuller

(10) Patent No.: US 11,795,741 B1
(45) Date of Patent: Oct. 24, 2023

(54) DOOR HOLDER

(71) Applicant: Nicolas Alexander Fuller, Charlotte, NC (US)

(72) Inventor: Nicolas Alexander Fuller, Charlotte, NC (US)

( * ) Notice: Subject to any disclaimer, the term of this patent is extended or adjusted under 35 U.S.C. 154(b) by 23 days.

(21) Appl. No.: 17/706,762

(22) Filed: Mar. 29, 2022

Related U.S. Application Data

(60) Provisional application No. 63/187,736, filed on May 12, 2021.

(51) Int. Cl.
*E05C 17/36* (2006.01)
*E05C 17/04* (2006.01)

(52) U.S. Cl.
CPC ..... *E05C 17/36* (2013.01); *E05C 17/047* (2013.01)

(58) Field of Classification Search
CPC ..... E05C 17/36; E05C 17/047
See application file for complete search history.

(56) References Cited

U.S. PATENT DOCUMENTS 878,607 A 2/1908 Cairns
1,234,158 A * 7/1917 Hall ..... E05C 19/182 292/295
2,199,369 A * 4/1940 Bernstein ..... E05C 17/36 292/288
3,451,708 A 6/1969 Brooks
3,781,046 A 12/1973 Hinkle
4,022,503 A * 5/1977 Bey ..... E05C 19/182 292/264
4,155,578 A * 5/1979 Rolland ..... E05C 19/182 292/292
4,811,454 A 3/1989 Crook
5,716,084 A * 2/1998 Sanford, Jr. ..... E05C 17/365 292/264
5,908,213 A * 6/1999 Tippetts ..... E05C 19/184 292/288
6,416,089 B1 * 7/2002 Williams, Jr. ..... E05C 19/182 292/288
6,976,716 B2 * 12/2005 Lin ..... E05C 19/182 292/296
10,041,273 B2 * 8/2018 Dieguez ..... E05C 17/505
2003/0132639 A1 * 7/2003 Franklin ..... E05B 17/005 292/288
2007/0085352 A1 * 4/2007 Ulanday ..... E05C 17/365 292/288

(Continued)

FOREIGN PATENT DOCUMENTS

GB 2432629 5/2007

*Primary Examiner* — Mark A Williams
(74) *Attorney, Agent, or Firm* — Kyle A. Fletcher, Esq.

(57) ABSTRACT

The door holder includes a flexlatch, a rigid plate, and a striker plate coupler. The door holder may be adapted to retain a door open at a fixed opening width such that a smaller pet may pass through the open doorway and a larger pet or a small child is prevented from passing through the open doorway. The door holder may couple between a door knob of the door and a striker plate in a door frame by securing the flexlatch around the door knob and by hooking the striker plate coupler onto the striker plate. Spring action of the flexlatch may assure that the striker plate coupler remains coupled to the striker plate. The flexlatch, the rigid plate, and the striker plate coupler may be formed into a single element that may hang from the door knob when not in use.

11 Claims, 3 Drawing Sheets

(56) References Cited

U.S. PATENT DOCUMENTS

| | | | | |
|---|---|---|---|---|
| 2013/0056998 | A1* | 3/2013 | Chincarini, Jr. | E05C 17/36<br>292/262 |
| 2022/0034132 | A1* | 2/2022 | Lee | E05C 17/36 |

* cited by examiner

DOOR HOLDER

CROSS REFERENCES TO RELATED APPLICATIONS

This application claims the benefit of priority to U.S. Provisional Application No. 63/187,736, filed May 12, 2021, which is incorporated by reference herein in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of door stops, more specifically, a door holder that couples between a door knob or door handle on a door and a striker plate on the door frame.

SUMMARY OF INVENTION

The door holder comprises a flexlatch, a rigid plate, and a striker plate coupler. The door holder may be adapted to retain a door open at a fixed opening width such that a smaller pet may pass through the open doorway and a larger pet or a small child is prevented from passing through the open doorway. The door holder may couple between a door knob of the door and a striker plate in a door frame by securing the flexlatch around the door knob and by hooking the striker plate coupler onto the striker plate. Spring action of the flexlatch may assure that the striker plate coupler remains coupled to the striker plate. The flexlatch, the rigid plate, and the striker plate coupler may be formed into a single element that may hang from the door knob when not in use.

An object of the invention is to retain a door in an open position at a fixed opening width such that a smaller pet may pass through the door opening but a larger pet is prevented from passing through the door opening.

Another object of the invention is to provide a flexlatch that removably couples to a door knob and provides spring action to retain a striker plate coupler in a striker plate.

A further object of the invention is to provide a rigid plate coupled to the flexlatch to prevent bending of the flexlatch in the gap between the door frame and the door.

Yet another object of the invention is to provide a door holder that may be installed with one hand and that may hang from the door knob when not in use.

These together with additional objects, features and advantages of the door holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the door holder in detail, it is to be understood that the door holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the door holder.

It is therefore important that the claims be regarded as including such equivalent construction insofar as they do not depart from the spirit and scope of the door holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive. Throughout this document, the terms "door knob" and "door handle" may be used interchangeably.

Figure 1:
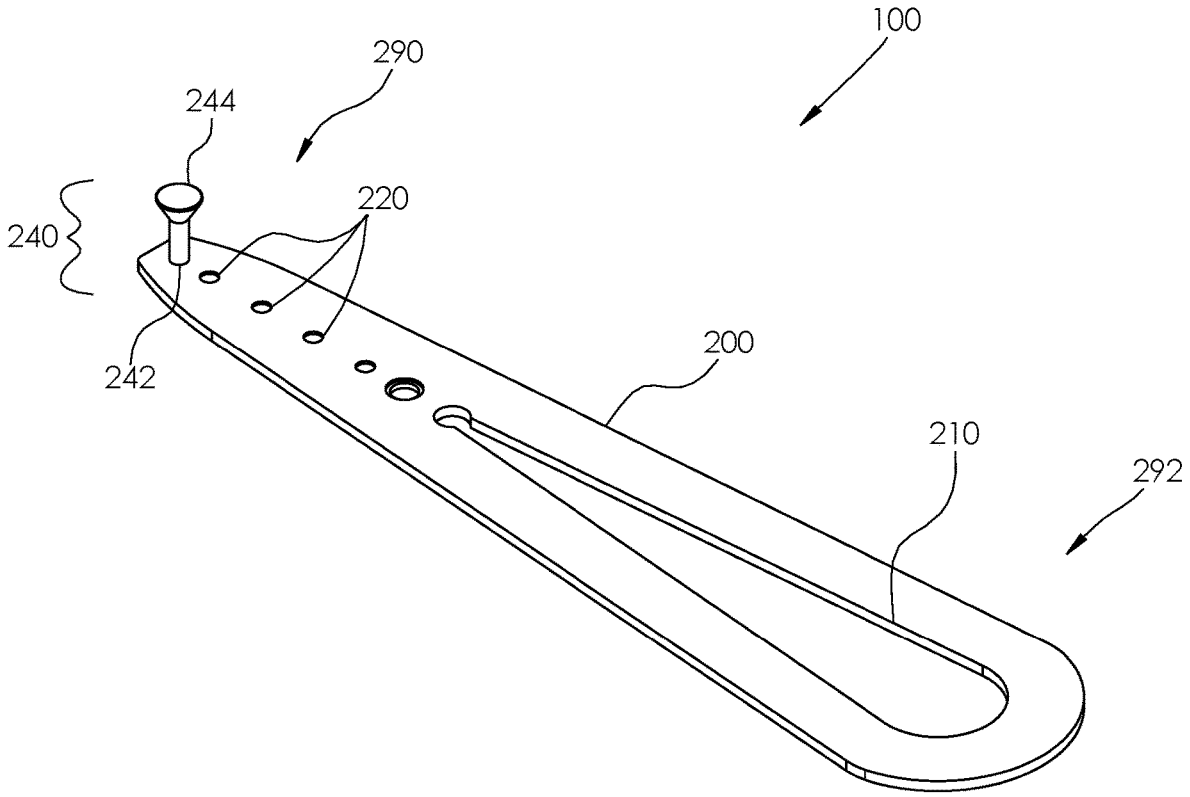
FIG. 1 is an isometric view of an embodiment of the disclosure.
Figure 2:
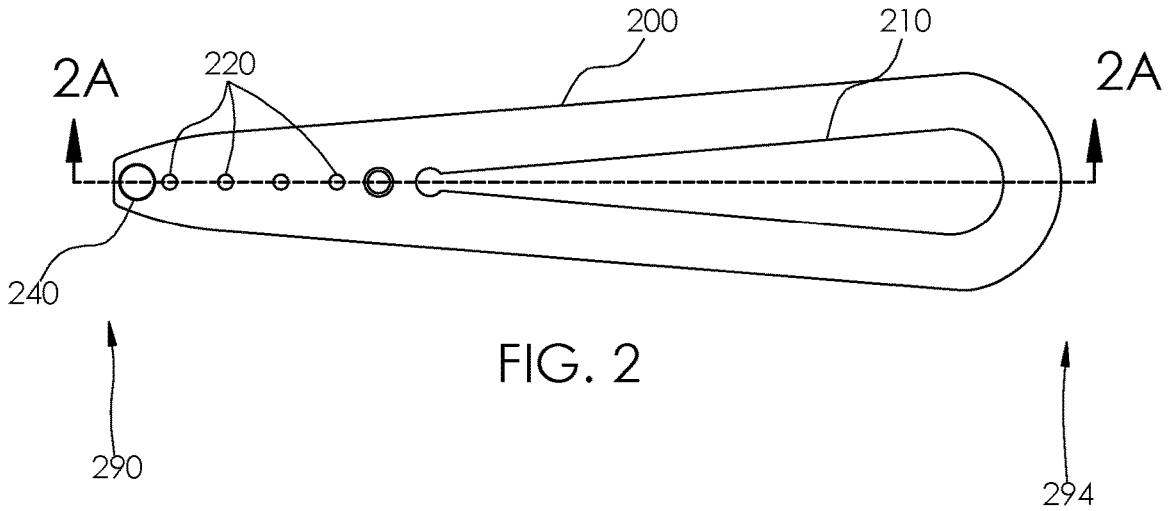
FIG. 2 is a top view of an embodiment of the disclosure.
Figure 2A:
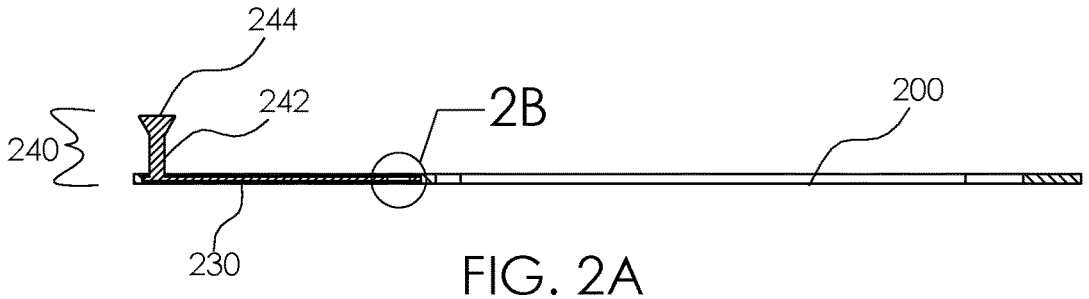
FIG. 2A is a cross-sectional view of an embodiment of the disclosure across A-A as shown in FIG. 2.
Figure 2B:
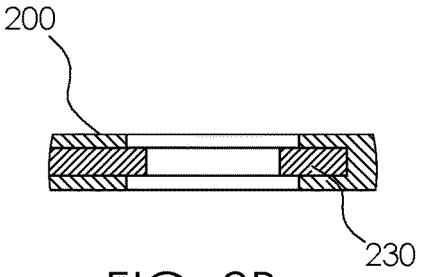
FIG. 2B is a detail view of an embodiment of the disclosure illustrating the area designated 2B in FIG. 2A.
Figure 3:
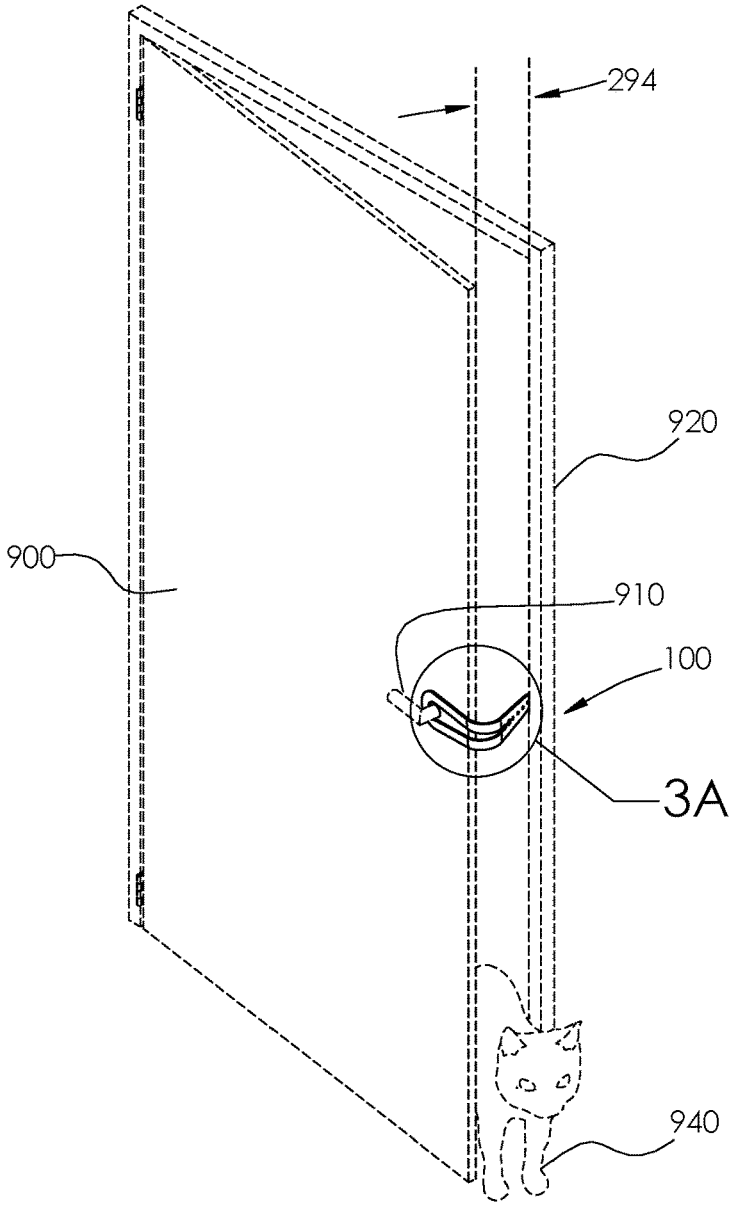
FIG. 3 is an in-use view of an embodiment of the disclosure.
Figure 3A:
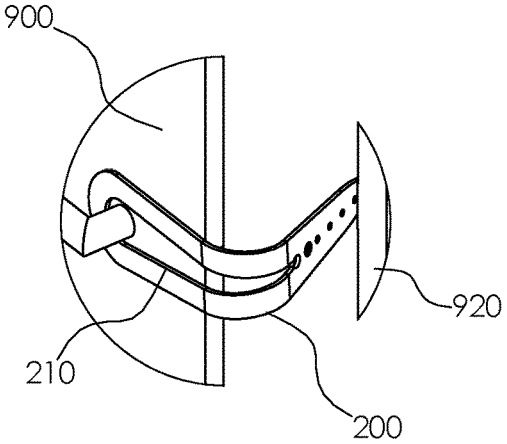
FIG. 3A is a detail view of an embodiment of the disclosure illustrating the area designated 3A in FIG. 3.

Detailed reference will now be made to a first potential embodiment of the disclosure, which is illustrated in FIGS. 1 through 3A.

The door holder 100 (hereinafter invention) comprises a flexlatch 200, a rigid plate 230, and a striker plate coupler 240. The invention 100 may be adapted to retain a door 900 open at a fixed opening width 294 such that a smaller pet 940 may pass through the open doorway and a larger pet or a small child is prevented from passing through the open doorway. The invention 100 may couple between a door knob 910 of the door 900 and a striker plate in a door frame 920 by securing the flexlatch 200 around the door knob 910 and by hooking the striker plate coupler 240 onto the striker plate. Spring action of the flexlatch 200 may assure that the striker plate coupler 240 remains coupled to the striker plate. The flexlatch 200, the rigid plate 230, and the striker plate coupler 240 may be formed into a single element that may hang from the door knob 910 when not in use.

The flexlatch 200 may be a flat strap having a generally teardrop shape—narrower at the proximal 290 end and wider at the distal 292 end. The flexlatch 200 may be made of a semi-rigid material such that the flexlatch 200 may bend but will exhibit the spring action by springing back to the original flat shape when the bending force is removed.

The flexlatch 200 may comprise a door knob aperture 210. The door knob aperture 210 may be adapted to secure the flexlatch 200 to the door knob 910 on the pull side of the door 900 by passing the door knob 910 through the door knob aperture 210. The door knob aperture 210 may be located on the distal 292 end of the flexlatch 200. The door knob aperture 210 may be oriented longitudinally. In some embodiments, the door knob aperture 210 may be a teardrop shape that mimics the footprint of the flexlatch 200.

The rigid plate 230 may be a stiffener that may be embedded within the flexlatch 200. The rigid plate 230 may establish the fixed opening width 294 by preventing a portion of the proximal 290 end of the flexlatch 200 from bending. The rigid plate 230 may be located at the proximal 290 end of the flexlatch 200. The rigid plate 230 may be oriented longitudinally within the flexlatch 200.

In some embodiments, the flexlatch 200 may comprise one or more retention apertures 220 such that an injection mold may retain the rigid plate 230 in place while the flexlatch 200 is molded around the rigid plate 230. In some embodiments, the rigid plate 230 may be made of metal. As non-limiting examples, the rigid plate 230 may be made of stainless steel or aluminum.

The striker plate coupler 240 may be a perpendicular projection from the proximal 290 end of the rigid plate 230. The striker plate coupler 240 may be operable to hook onto the striker plate located on the door frame 920. As a non-limiting example, the striker plate coupler 240 may comprise a shaft 242 with a head 244. The shaft 242 may extend into a striker plate aperture and the head 244 may prevent the shaft 242 from sliding out of the striker plate aperture. The head 244 may have a diameter that is larger than the diameter of the shaft 242 such that the head 244 may prevent the shaft 242 from decoupling from the striker plate. In some embodiments, the invention 100 may be available in more than one size such that the size of the doorway opening may be selectable. As non-limiting examples, the lengths of the flexlatch 200, the rigid plate 230, the door knob aperture 210, or any combination thereof may be changed to provide large or smaller opening widths.

In use, the invention 100 may be installed on a door 900 to hold the door 900 open at a fixed opening width 294 such that a smaller pet 940 may pass through the open doorway while a larger pet or a small child is prevented from passing through the open doorway. As a non-limiting example, the invention 100 may allow a cat to enter a room where a litter box is located while preventing a dog from entering the room.

The invention 100 may be installed using one hand. First, the flexlatch 200 may be looped over the door knob 910 on the pull side of the door 900 by passing the door knob 910 through the door knob aperture 210 in the flexlatch 200 with the striker plate coupler 240 facing away from the door 900. Then, the flexlatch 200 may be pivoted to a horizontal orientation and bent around the door 900 towards the striker plate until the striker plate coupler 240 is aligned with the striker plate. Finally, the striker plate coupler 240 may be inserted into the striker plate aperture and released. The spring action of the flexlatch 200 may push the striker plate coupler 240 towards the striker plate and may thereby prevent the striker plate coupler 240 from pulling out of the striker plate.

The invention 100 may be left hanging from the door knob 910 when not in use and will not interfere with normal operation of the door 900.

Definitions

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "door" may be a movable or removable barrier that is attached to the wall of a room or the surface of a container for the purpose of allowing or preventing access through an aperture into the room or container.

As used here, "footprint" may refer to a projection of an object onto the surface that supports the object. The projection is usually, but not always, vertically downward.

As used in this disclosure, "horizontal" may be a directional term that refers to a direction that is perpendicular to the local force of gravity. Unless specifically noted in this disclosure, the horizontal direction is always perpendicular to the vertical direction.

As used herein, the word "longitudinal" or "longitudinally" may refer to a lengthwise or longest direction.

As used in this disclosure, "orientation" may refer to the positioning and/or angular alignment of a first object relative to a second object or relative to a reference position or reference direction.

As used herein, "pull side" refers to the surface of a door which leads into (or faces) the room or space into which the door is being opened. "Push side" may refer to the side of a door that is opposite the pull side.

As used herein, "resilient" or "semi-rigid" may refer to an object or material which will deform when a force is applied to it and which will return to its original shape when the deforming force is removed.

As used herein, "rigid" may refer to an object or material which is inflexible.

As used herein, "striker plate" may refer to a metal plate coupled to a door frame. The end of a spring-lock bolt may strike the striker plate as the door is closed. The spring-lock bolt may extend into a striker plate aperture when the door is closed.

With respect to the above description, it is to be realized that the optimum dimensional relationship for the various components of the invention described above and in FIGS. 1 through 3A, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A door holder comprising:

a flat strap of flexible material, a rigid plate, and a striker plate coupler, the rigid plate having at least a first end portion joining with at least a portion of a proximal end of the flat strap, and the striker plate coupler formed at a second end of the rigid plate opposed to the first end portion;

wherein the door holder is adapted to hold a door open at a fixed opening width such that a pet of a first size is able to pass through an open doorway of said door and a pet or a child of a second size is to be prevented from passing through the open doorway of said door;

wherein the door holder is adapted to couple between a door knob of the door and a striker plate in a door frame by securing the flat strap around the door knob and by hooking the striker plate coupler onto the striker plate;

wherein the flat strap assures that the striker plate coupler remains coupled to the striker plate;

wherein the rigid plate establishes the fixed opening width by preventing the portion of the proximal end of the flat strap from bending.

2. The door holder according to claim 1 wherein the flat strap having a teardrop shape narrower at a proximal end and wider at a distal end;

wherein the rigid plate is embedded within the flat strap;

wherein the flat strap, the rigid plate, and the striker plate coupler are formed into a single element that is configured to hang from the door knob when not in use;

wherein the flat strap is made of a semi-rigid material such that the flat strap bends but will return to an original flat shape when a bending force is removed.

3. The door holder according to claim 2 wherein the flat strap comprises a door knob aperture;

wherein the door knob aperture is adapted to secure the flat strap to the door knob on the pull side of the door by passing the door knob through the door knob aperture.

4. The door holder according to claim 3 wherein the door knob aperture is located on the distal end of the flat strap.

5. The door holder according to claim 4, wherein the door knob aperture is a teardrop shape that mimics a footprint of the flat strap.

6. The door holder according to claim 4 wherein the rigid plate is located at the proximal end of the flat strap.

7. The door holder according to claim 6 wherein the flat strap comprises one or more retention apertures such that an injection mold retains the rigid plate in place while the flat strap is molded around the rigid plate.

8. The door holder according to claim 7 wherein the striker plate coupler is a perpendicular projection from the proximal end of the rigid plate;

wherein the striker plate coupler is operable to hook onto the striker plate located on the door frame.

9. The door holder according to claim 8 wherein the striker plate coupler comprises a shaft with a head;

wherein the shaft extends into a striker plate aperture and the head prevents the shaft from sliding out of the striker plate aperture.

10. The door holder according to claim 9 wherein the head has a diameter that is larger than the diameter of the shaft such that the head prevents the shaft from decoupling from the striker plate.

11. The door holder according to claim 10 wherein the door holder is available in more than one size such that the size of the doorway opening is selectable.

* * * * *